US005551592A

United States Patent [19]

Barton et al.

[11] Patent Number: 5,551,592

[45] Date of Patent: Sep. 3, 1996

[54] BEVERAGE HOLDER

[75] Inventors: Bradley D. Barton; Jimi Ellis, both of San Antonio, Tex.

[73] Assignee: Radio Cap Company, Inc., San Antonio, Tex.

[21] Appl. No.: 437,324

[22] Filed: May 9, 1995

[51] Int. Cl.[6] ..... B65D 90/04

[52] U.S. Cl. ..... 220/571; 220/412; 220/739

[58] Field of Search ..... 220/737, 412, 220/413, 410, 571, 739

[56] References Cited

U.S. PATENT DOCUMENTS 4,163,374 8/1979 Moore et al. ..... 220/412
4,830,190 5/1989 Inagaki ..... 220/412

OTHER PUBLICATIONS

Drawing of a foam beverage holder liner manufactured by Spirit Manufacturing Co., Leesburg, FL. The liner was displayed at the PROMOTION PRODUCTS ASSOCIATION INTERNATIONAL 1994 SHOW; Dallas TX; Jan. 24–28. '1994.

*Primary Examiner*—Joseph M. Moy
*Attorney, Agent, or Firm*—Robert A. McFall

[57] ABSTRACT

A beverage holder has a thermally insulative sleeve disposed around a liner having a plurality of radially outwardly extending, longitudinally oriented ridges on an exterior surface that maintain the sleeve in a fixed relationship with the liner during rapid movement of the assembled holder. The liner also has a radial flange with a circumferential lip that extends outwardly over and along an upper portion of the insulative sleeve. The assembled beverage holder is particularly adapted for the rapid movement and accurate high speed positioning associated with multi-color direct screen imprint processes.

7 Claims, 1 Drawing Sheet

BEVERAGE HOLDER

TECHNICAL FIELD

This invention relates generally to a hand grippable device for holding beverage containers, and more particularly to such a device having an inner liner surrounded by a foam sleeve.

BACKGROUND ART

Foam beverage insulators, such as the Koozie™ brand beverage holder manufactured by Radio Cap Company, Inc., the assignee of the present invention, have been widely accepted as a convenient and comfortable device for holding beverage containers, particularly cans of cold beverages. The foam insulator slows the transfer of heat to the cold beverage and provides a relatively soft, easily deformable surface that provides a pleasing response to the tactile senses when gripped by the hand.

Because of its relatively low cost, foam beverage insulators are desirable advertising tools on which messages or logos can be imprinted. Heretofore foam beverage holders have been generally formed of a single color material and have been difficult, or prohibitively costly, to imprint with more than one color. Multi-color imprinting on foam insulators presently requires transfer printing, a process that is significantly more expensive than a direct screen imprint, or the use of very expensive equipment that optically or mechanically aligns and positions the insulator between successive imprint operations. These high costs are unacceptable when compared with the otherwise low unit cost of producing foam beverage insulators.

Also, beverage cans are sometimes difficult to remove from a foam insulator, often causing tears in the foam. In response to this problem, a cup-shaped liner that fits inside the foam insulator has been produced by Spirit Manufacturing of Leesburg, Fla. The liner is formed of a relatively hard plastic material, has a smooth outer circumferential surface and a reference index tab formed on the exterior bottom of the liner. Attempts to direct screen imprint two or more colors on a foam sleeve encircling the liner, using the reference index tab for alignment, have not been successful due to slipping of the sleeve with respect to the liner between imprints. The alignment of the reference tab prior to each direct screen imprint requires rapid rotation of the liner to the required orientation. To be economically viable, the imprint operation occurs at relatively high speed, and accordingly the spinning and orientation of the liner takes place quickly with high acceleration and deceleration forces being imposed on the assembled liner and sleeve. This has led to angular slippage of the sleeve with respect to the liner resulting in a high percentage of misaligned imprints on the sleeves.

In addition, the liner produced by Spirit Manufacturing has a length that is shorter than the surrounding sleeve. That construction enables the upper end of the sleeve to extend upwardly above the liner, making it difficult to insert or withdraw a beverage can without dragging against the sleeve. Such contact often causes tearing or other damage to the sleeve. Also, during use, the liner can slip with respect to the sleeve so that the bottom of the liner is exposed below the sleeve. The Spirit Manufacturing liner has one or more holes through the bottom of the liner to drain condensation, and consequently when the bottom is exposed below the sleeve, setting the beverage holder on a surface causes water to be deposited, often disadvantageously, on the supporting surface.

The present invention is directed to overcoming the problems set forth above. It is desirable to have a beverage holder with separate liner and foam components in which the liner extends outwardly over the upper end of the sleeve to protect the sleeve and provide positive axial positioning of the liner and sleeve. It is also desirable to have a liner and sleeve that may be formed of different colors to provide a two-tone appearance to the assembled beverage holder. Furthermore, is desirable to have a beverage holder comprising a liner and sleeve that, upon assembly together, are maintained in a fixed radial relationship whereby the assembly can be rapidly positioned and imprinted with different colors, in accurate registration with each other, during multiple direct screen imprinting operations.

DISCLOSURE OF THE INVENTION

In accordance with one aspect of the present invention, a beverage holder has a thermally insulative sleeve having cylindrical outer and inner wall surfaces, each having a predetermined diameter and disposed along a longitudinal axis in radially spaced relationship to one another. The insulative sleeve also has first and second end surfaces that extend radially between the outer and inner cylindrical walls and are axially spaced along the longitudinal axis from each other. The beverage holder also includes a liner having a cylindrical wall portion that is concentrically disposed about the longitudinal axis and has an outer surface extending between first and second axially spaced ends. The outer surface of the cylindrical wall portion has a diameter substantially equal to the diameter of the inner wall surface of the sleeve and has a plurality of ridges extending radially outwardly from the outer surface and in a direction parallel with the longitudinal axis. The liner has a bottom portion that extends radially across the first end of the wall portion and has an exterior surface on which a reference indicia is disposed.

Another feature of the beverage holder embodying the present invention includes a radial flange disposed at the second end of the liner. The radial flange extends radially outwardly from the outer surface of the wall portion of the liner and completely covers the second end surface of the sleeve.

In another aspect of the present invention, a liner for a beverage holder having a longitudinal axis includes a cylindrical wall portion having an outer surface extending between spaced apart ends and a plurality of ridges that extend radially outwardly from the outer surface and in a direction parallel with the longitudinal axis. The liner also has a bottom portion that extends radially across one of the spaced ends and has a reference indicia disposed on an exterior surface of the bottom portion.

BEST MODE FOR CARRYING OUT THE INVENTION

Figure 1:
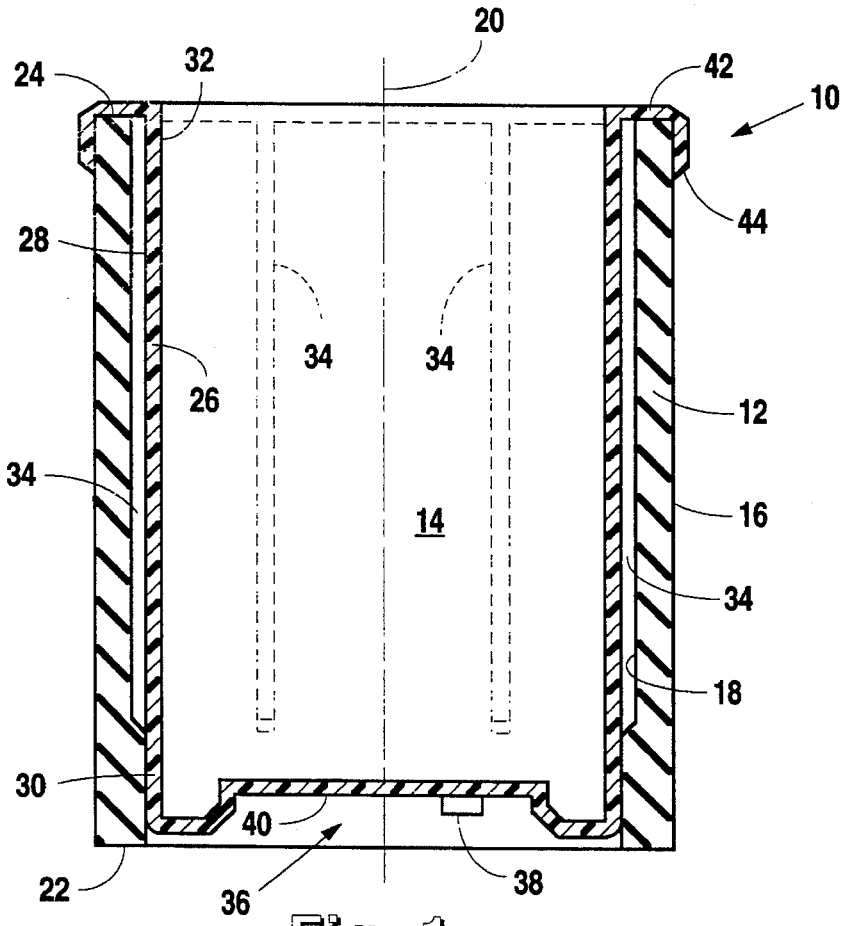
FIG. 1 is a sectional view of the beverage holder embodying the present invention.

In the preferred embodiment of the present invention, a beverage holder 10 has a thermally insulative outer sleeve 12 and an inner liner 14. The term "beverage holder" is used herein to describe a holder for beverage containers, such as 12 ounce cans of a beverage, and not as a direct holder, i.e., a container, for beverages. The thermally insulative outer sleeve 12 is conventionally formed of a relatively soft, resilient material, such as flexible foamed PVC nitryl. The sleeve 12 has an outer wall surface 16 and an inner wall surface 18 each of which are formed to a predetermined diameter and are concentrically disposed about a longitudinal axis 20 in radially spaced relationship with each other. In an illustrative example of the preferred embodiment of the present invention, the inner wall surface 18 has a diameter of 6.87 cm (2.7 in) and the outer wall surface 16 has a diameter of 8.15 cm (3.2 in) Thus, the inner and outer wall surfaces 18,16 are radially spaced apart by a distance of 0.64 cm (0.25 in).

The sleeve 12 also has a first end surface 22 and a second end surface 24, respectively disposed at the bottom and top of the sleeve 12 as seen in FIG. 1, that extend radially with respect to the longitudinal axis 20 between the inner and outer wall surfaces 18,16. In the illustrative example of the beverage holder 10 embodying the present invention, the first and second end surfaces 22,24 are spaced apart along the axis 20 a distance of 10.8 cm (4.25 in). Thus, the sleeve 12 has an annular cylindrical shape with a wall thickness of 0.64 cm (0.25 in) and a length of 10.8 cm (4.25 in).

The liner 14 of the beverage holder 10 is formed of a moldable plastic material, such as polypropylene or polyethylene, that is significantly stiffer and harder than the insulative sleeve 12. The liner 14 thus forms a structural support for the flexible sleeve 12 and, as described below in more detail, is constructed to maintain the sleeve 12 in a fixed angular and axial relationship with the liner 14. The liner 14 has a cylindrical wall portion 26 that is concentrically disposed about the longitudinal axis 20 and has an outer surface 28 that extends between a first end 30 at the bottom of the liner 14, and a second end 32 at the top of the liner 14. The diameter of the outer surface 28 is substantially equal to the diameter of the inner wall surface 18 of the sleeve 12, which in the above described illustrative example is 6.87 cm (2.7 in). Desirably, the thickness of the cylindrical wall portion 26, and the other portions of the liner 14, is about 0.1 cm (0.04 in).

Figure 2:
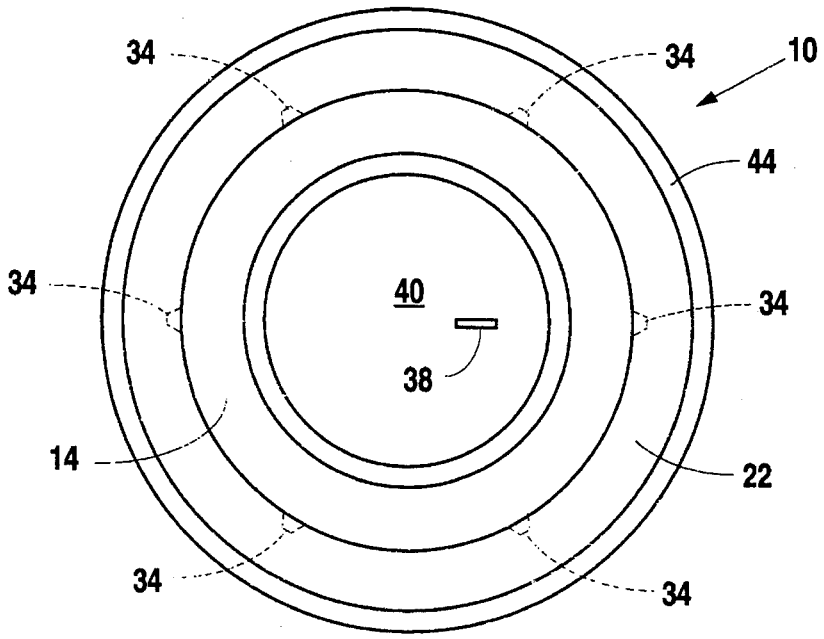
FIG. 2 is a bottom view of the beverage holder embodying the present invention.

Importantly, the liner 14 has a plurality of longitudinally disposed ridges 34 that extend radially outwardly from the outer surface 28 of the wall portion 26 a distance sufficient to compress, and thereby resiliently deform, a portion of the inner wall surface 18 of the sleeve 12. It is essential that the ridges have sufficient height and length so that, after assembly, the sleeve 12 is securely maintained in a fixed position with respect liner 14. In the illustrative example of the preferred embodiment of the present invention, six equidistantly circumferentially spaced ridges 34 each have a triangular sectional shape, as best shown in FIG. 2, that is 0.1 cm (0.041 in) wide at the base and 0.04 cm (0.016 in) high. Thus, the ridges extend radially outwardly from the outer surface 28 of the liner 14 a distance equal to about 6% of the radially spaced distance between the inner and outer wall surfaces 18,16 of the sleeve 12. Preferably, the ridges have a height of at least 5% of the thickness of the sleeve 12, although it should be realized that the actual height required to engage and maintain the sleeve 12 may be more or less than that value, depending upon the material characteristics of the sleeve 12. It is also desirable that the ridges 34 extend over at least 50% of the length of the outer surface 28, and preferably over at least 75% of the length of the outer surface 28. In the example described and illustrated herein, each the ridges 34 have a length of 8.9 cm (3.5 in), thus extending along 87.5% of the length of the outer surface 28.

The liner 14 also has a bottom portion 36 that extends across the bottom, or first end 30, of the cylindrical wall portion 26. The bottom portion 36 has a reference indicia 38, such as a rectangular tab, extending outwardly from an exterior surface 40. Desirably, the reference tab 38 is formed in a recessed area of the bottom portion 36 so that it will not extend beyond the bottom of the liner 14. The reference indicia 38 is used to orient the liner 14, and accordingly the sleeve 12 assembled on the liner 14, during each step of a multiple color direct screen imprinting operation wherein two or more colors are printed, in accurate registration with each other, on the outer wall surface 16 of the sleeve 12. The tab 38 engages a slot provided on a rotatable indexing member associated with the imprinting press. The indexing member then rapidly rotates the tab 38 to a predetermined position, and the liner 14 with the sleeve 12 securely assembled therewith, are thus accurately aligned at the predetermined position prior to each direct screen imprint. In the described example, the reference tab 38 has a length of about 0.64 cm (0.25 in) and a height of about 0.25 cm (0.1 in).

The liner 14 also has a flange 42 that extends radially outwardly from the outer surface 28 at the upper, or second, end 32 of the wall portion 26. Importantly, the flange 42 extends completely over the second end surface 24 of the sleeve 12 providing a protective cover over the otherwise exposed end surface 24 and a beneficial guide, or target, for directing and receiving a beverage container into the liner 14. The flange 42 also has a cylindrical lip 44 circumferentially disposed at the radially outer edge of the flange 42. The lip 44 extends downwardly over a portion of the cylindrical outer wall surface 16 of the sleeve 12, providing additional protection of the upper end of the more easily damaged sleeve 12, and positive longitudinal retention of the sleeve 12 with respect to the liner 14. Furthermore, when the liner 14 and sleeve 12 may be formed of different color materials, whereby the radial flange 42 and the circumferentially disposed outer lip 44 advantageously provides an ascetically pleasing two-tone appearance.

In the illustrative example of the preferred embodiment of the present invention, the length of the liner 14, measured from the underside of flange 42 to the farthest extending surface of the bottom portion 36 is 10.3 cm (4.04 in), which is 0.5 cm (0.21 in) less than the above described length of the sleeve 12. Therefore, when the sleeve 12 is assembled over the outer surface 28 of the liner 14, with the upper end 24 of the sleeve 12 in abutment with the bottom surface of the flange 42, the sleeve 12 will extend 0.5 cm (0.21 in) beyond the bottom of the liner 14. The extension of the sleeve 12 provides a desirable soft, cushioned, surface when setting the beverage holder 10 on a table or other supporting surface, and prevents contact between the bottom of the relatively hard liner 14 with the supporting surface.

INDUSTRIAL APPLICABILITY

Heretofore, it has been prohibitively costly to print designs having more than one color on the exterior surface of foam beverage holders. The beverage holder 10 embodying the present invention provides a liner 14 having surface features 34 that maintain a foam insulative sleeve 12 in a fixed position with respect to the liner 14 during rapid rotary and axial movement. When the liner 14 is positioned in a desired orientation, the affixed sleeve 12 is also accurately positioned, permitting multiple direct screen imprint of slogans, logos and other designs or messages having different colors in precise registration, directly on the outer wall surface 16 of the insulative sleeve 12.

The liner 14 of the beverage holder 10 also decreases the thermal conductivity of the holder 10 and provides a protective flange and radial lip over the otherwise exposed upper end of the outer sleeve 12. The last mentioned feature permits easier insertion and withdrawal of a beverage container from the holder 10. Also, because of separate sleeve 12 and liner 14 components, the beverage holder 10 to be easily assembled of a sleeve 12 and liner 14 having complimentary or contrasting colors.

Another important feature of the beverage holder 10 embodying the present invention is the positive axial retention of the sleeve 12 against the flange 42 and circumferential lip 44 at the upper end of the liner 14. This feature prevents the sleeve 12 from slipping with respect to the liner 14 so that the slightly longer length of the sleeve 12 extends below the bottom of the liner 14 and provides an desirable cushioned support for the holder 10.

Other aspects, features and advantages of the present invention can be obtained from a study of this disclosure together with the appended claims.

What is claimed is:

1. A beverage holder assembly, comprising:

a thermally insulative sleeve formed of a resiliently compressible material and having a cylindrical outer wall surface and a cylindrical inner wall surface, said outer and inner wall surfaces each having a predetermined diameter and each being concentrically disposed about a longitudinal axis in radially spaced relationship with each other, and a first end surface and a second end surface, said first and second end surfaces extending between said outer and inner wall surfaces in a radial direction with respect to said longitudinal axis and in a predetermined axially spaced relationship with each other;

a liner disposed within said sleeve and having a cylindrical wall portion concentrically disposed about said longitudinal axis, said wall portion having an outer surface extending between first and second axially spaced ends and having a diameter substantially equal to the diameter of said inner wall surface of the sleeve and disposed in abutting contact with the inner wall surface of said insulative sleeve, a plurality of ridges extending radially outwardly from said outer surface of the liner and along said outer surface in a direction parallel with said longitudinal axis wherein the outward and longitudinal extension of the ridges above and along the outer surface of the liner is sufficient to resiliently compress an adjacently disposed area of the abutting inner wall surface of said sleeve and thereby maintain the sleeve in a fixed relative position with respect to the liner during spinning of the assembly about said longitudinal axis, and a bottom portion extending radially across said first end of the wall portion and having an exterior surface with a reference indicia disposed thereon.

2. A beverage holder, as set forth in claim 1, wherein said liner includes a flange extending radially outwardly from the outer surface at the second end of the wall portion completely covering the second end surface of said sleeve.

3. A beverage holder, as set forth in claim 2, wherein said flange includes a cylindrical lip disposed at a radially outer edge of the flange, said cylindrical lip extending over a portion of the cylindrical outer wall surface of said sleeve.

4. A beverage holder, as set forth in claim 1, wherein said ridges extending radially outwardly frown the outer surface of the wall portion of said liner, extend longitudinally along at least about 50% of the spaced distance between the first and second ends of said liner.

5. A beverage holder, as set forth in claim 1, wherein said ridges extend radially outwardly from the outer surface of the wall portion of said liner a distance sufficient to compressibly deform a correspondingly disposed portion of the inner wall surface of said sleeve.

6. A beverage holder, as set forth in claim 5, wherein said ridges extend radially outwardly from the outer surface of the wall portion a distance equal to a least 5% of the radially spaced distance between the inner and outer wall surfaces of said sleeve.

7. A beverage holder, as set forth in claim 1, wherein the predetermined axial distance between the first and second ends of the sleeve is greater than the distance between the first and second axially spaced ends of the liner.

* * * * *